United States Patent [19]

Koconis

[11] Patent Number: 4,742,629

[45] Date of Patent: May 10, 1988

[54] PICTURE FRAME

[76] Inventor: James C. Koconis, 2463 S. Graham St., Milwaukee, Wis. 53207

[21] Appl. No.: 936,730

[22] Filed: Nov. 28, 1986

[51] Int. Cl.[4] ..... G09F 1/12

[52] U.S. Cl. ..... 40/152.1; 40/124.1; 40/159; 248/459

[58] Field of Search ..... 40/124.1, 152.1, 158, 40/159; 248/459, 472

[56] References Cited

U.S. PATENT DOCUMENTS

| | | | |
|---|---|---|---|
| 1,992,487 | 2/1935 | Jones | 40/152.1 |
| 2,758,402 | 8/1956 | Fulmer | 40/152.1 |
| 3,108,696 | 10/1963 | Winner | 40/124.1 |
| 3,579,887 | 5/1971 | Rochelt | 40/152.1 |
| 4,216,936 | 8/1980 | Deselms | 40/152.1 |
| 4,229,892 | 10/1980 | Hueter et al. | 40/152.1 |

*Primary Examiner*—Gene Mancene

*Assistant Examiner*—Wenceslao J. Contreras

*Attorney, Agent, or Firm*—James B. Middleton

[57] ABSTRACT

An easy to assemble picture frame is formed of double sheet material. The double sheet material has two parallel sheets with spacers forming parallel channels between the sheets. The material is die cut, and the material can be cut except for one sheet to form a natural hinge. A frame is cut to receive a picture, and a backing holds the picture against the frame. The backing can be hinged to the frame and either held by a clamping arrangement or frictionally engaged with the material. A base can be hinged to the picture frame, and malleable wires in the channels of the double sheet material hold the hinge in the desired position. A notch may be provided in the backing, and a rigid stand can be received in the notch to support the frame. In some embodiments, a transparent clamp holds the frame and backing together and provides a protective panel.

3 Claims, 3 Drawing Sheets

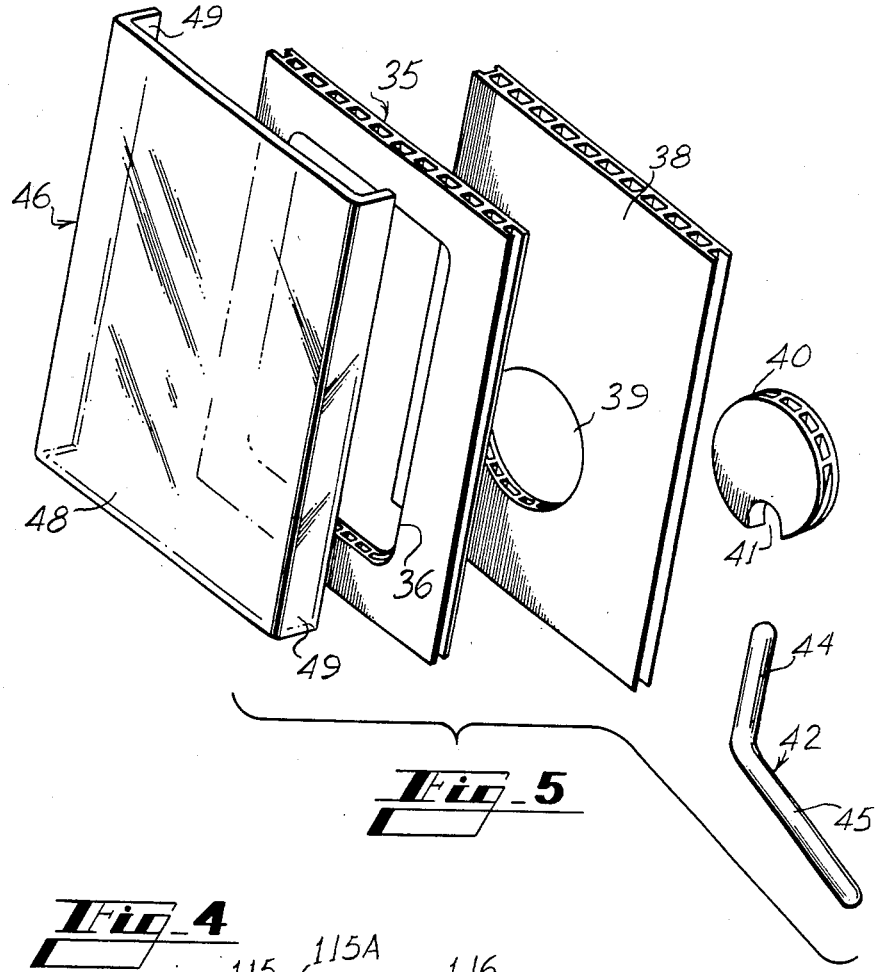
Fig. 5
Fig. 4
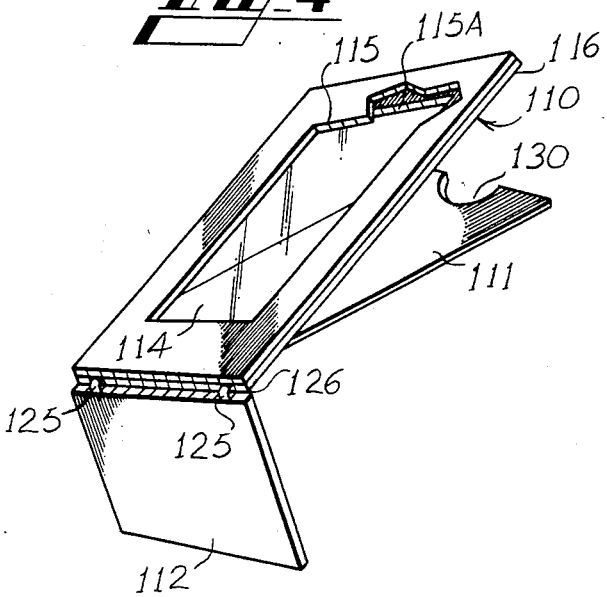
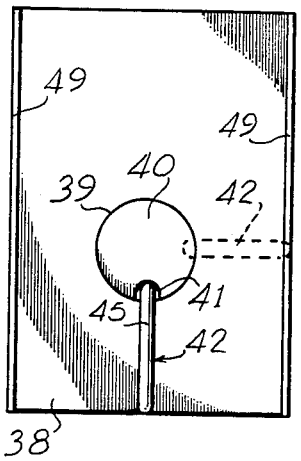
Fig. 6

PICTURE FRAME

INFORMATION DISCLOSURE STATEMENT

The prior art includes a great number of picture frames or document mounts that are intended to be simple to construct and to use. Early forms of picture frames are generally constructed of stiff paper or card stock and are arranged so that a photograph or the like can be inserted beneath a frame member. Such frames are frequently provided with stands so the frame can be displayed on a desk or a table.

One of the difficulties with these paper picture frames is that the pieces must be die cut, and the die is frequently required to be relativity complex to provide the various pieces of both the frame and the stand. After cutting, the frames must be assembled, and almost always with the use of glue, staples or the like. Another disadvantage is that, since the frames are paper, they can become soiled but they are not washable. If the frames are in the presence of excessive moisture, the paper will warp, or completely disintegrate.

Another well known picture frame is made by simply sandwiching a picture or the like between sheets of plastic material. One of the sheets will generally be transparent, though backing sheets may be transparent, opaque or translucent. The several sheets are then clipped or clamped together to hold a picture therebetween.

While these frame made of plastic sheets appear quite simple, the primary difficulty is in the requirement for the clips or clamps. A simple clip arrangement may be easy to use and relatively inexpensive to manufacture, but they are frequently removed inadvertently, causing the entire assembly to fall apart. More durable clamping arrangements may not fall off inadvertently, but they are frequently expensive to manufacture and difficult to use.

SUMMARY OF THE INVENTION

This invention relates generally to picture frames, and is more particularly concerned with a simple picture frame formed of die cut material that is simple to use and durable in operation.

The present invention provides picture frames ultilizing sheet material comprising two parallel sheets with spacers therebetween defining parallel channels. Because of the construction of this material one side of the material can be cut, and the spacers can be severed, so the remaining sheet acts as a hinge. The hinge may be freely pivotal, or malleable wires or the like can be inserted into the channels between the parallel sheets to cause the hinge to retain its set position.

In one form of the present invention, a stand for the frame cooperates with a tab on the backing to hold the backing against the frame member. In a similar embodiment of the invention a piece of the sheet material is cut leaving a hinge, so the backing can be hinged away from the frame to receive the picture, and the tight fit due to the simple slit providing the backing provides sufficient engagement to retain the backing in place.

In another embodiment of the invention, an additional member formed of transparent material covers the entire frame and holds portions of the frame together, and a stand can be provided by inserting a generally rigid member into channels between the parallel sheets.

In all embodiments of the present invention, the double sheet material is die cut into simple patterns, and the material must be folded, glued and the like by the manufacturer; then, the user can very easily insert the picture and urge the backing against the picture.

BRIEF DESCRIPTION OF THE DRAWINGS

These and other features and advantages of the present invention will become apparent from consideration of the following specification when taken in conjunction with the accompanying drawings in which:

FIG. 4 is a perspective view showing a modified form of picture frame made in accordance with the present invention, the backing being hinged outwardly to receive a picture;

FIG. 5 is an exploded perspective view showing another modified form of the present invention;

FIG. 6 is a rear elevational view of the frame shown in FIG. 5;

DETAILED DESCRIPTION OF THE EMBODIMENTS

Figure 1:
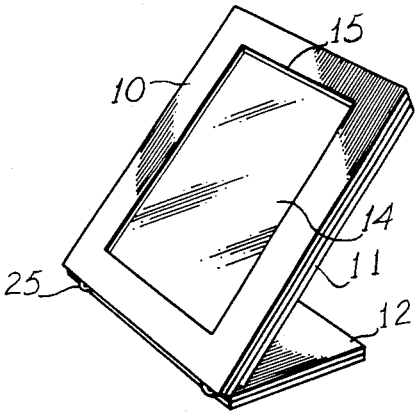
FIG. 1 is a perspective view showing a completely assembled picture frame made in accordance with the present invention.

Referring now more particularly to the drawings, and to those embodiments of the invention here presented by way of illustration, FIG. 1 shows a picture frame made in accordance with the present invention wherein the frame includes a frame member 10 and a parallel backing member 11 supported on a stand 12. The frame member 10 may have a protective sheet of transparent material 14 large enough to cover the opening 15 in the frame 10, but small enough to remain within the confines of the backing 11.

The present embodiment, and all the embodiments of the invention here presented, are constructed of a double sheet plastic material having spacers between the two sheets. The effect is similar to the well-known corrugated pasteboard or the like, but the material is formed by extrusion or a comparable process, and the material is made of polyproplene. Those skilled in the art will understand that other plastic materials could be equally well ultilized, and it would be possible to ultilize corrugated pasteboard in constructing the frames, though of course they would not be as durable as the plastic materials. Also by way of example, the material readily available on the market is about 5/32 inch thick or about 4 mm thick, and the individual sheets of the double sheet material are approximately 0.3 mm thick.

Figure 2:
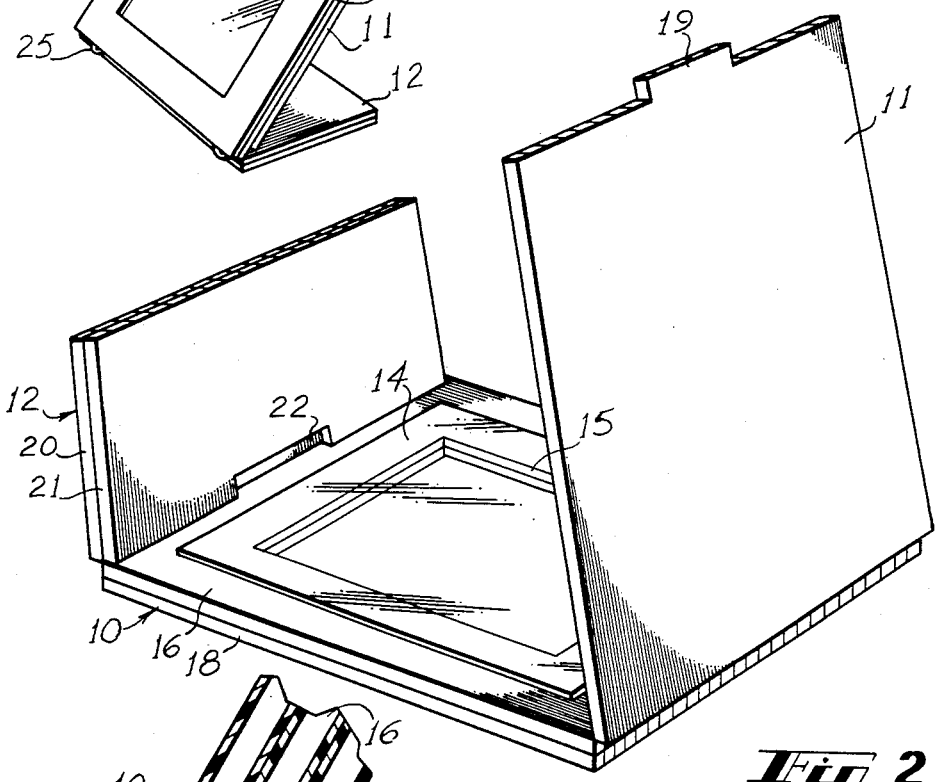
FIG. 2 is a perspective view showing the device of FIG. 1 partially unfolded to reveal the structure thereof.
Figure 3:
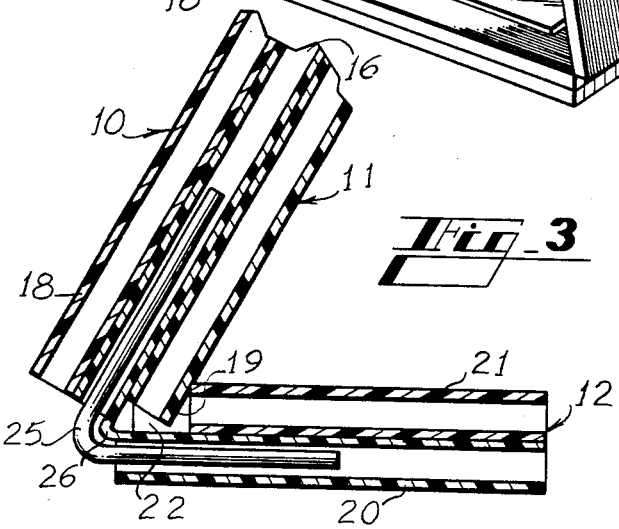
FIG. 3 is an enlarged cross-sectional view taken substantially along the line 3—3 in FIG. 1.

Returning now to the embodiment of the invention illustrated in FIGS. 1, 2 and 3, it will be seen that the frame 10 is formed of two identically cut panels 16 and 18. The rear panel 16 could be used alone; however, the front panel 18 can be cut from material of a different color and glued or sealed to the back panel 16 to provide attractive variety in coloration of the frame.

The backing 11 is shown as formed integrally with the frame member 16, the material being cut through, but leaving one sheet of the double sheet material to act as a hinge. Thus, the backing 11 has substantially the same outside dimensions as the frame member 16, and is hinged to move towards and away from the member 16.

The lower end of the backing member 11 includes an extending tab 19 which is the tab portion of a locking means which will be discussed below.

Looking now at the base 12, it will be seen that the base 12 is also formed of two thicknesses of the sheet material indicated at 20 and 21. For the base 12, the member 20 is formed integrally with the member 16, and is cut to have a remaining hinge so that the base 12 is hinged with respect to the frame member 10. If desired, the member 21 can be formed from the same piece, the sheet being partially cut through to allow the member 21 to be folded over the member 20, then glued or otherwise fixed in place. The base 12 includes a notch 22 centrally thereof, and adjacent to the frame member 10.

Looking at FIG. 3 of the drawings it will be seen that, when the base 12 is hinged to be at an acute angle with respect to the frame member 10 and backing 11, the notch 22 in the upper member 21 of the base 12 is positioned to engage the tab 19 extending from the backing 11. Thus, it should be readily understood that the transparent protective sheet 14 can be placed over the opening 15 in the member 16, and a picture can be placed over the protective sheet 14. Next, the backing 11 will be pivoted downwardly against the picture and held while the base member 12 is hinged to form an acute angle with the backing 11. By this simple procedure, the backing 11 is held against the picture so the entire assembly will stay together.

The only thing required, then, is to cause the base 12 to remain at the desired angle with respect to the frame member 10. To achieve this, malleable members 25 are inserted into channels in the double sheet material intersecting the hinge. The hinge for the base is designated in FIG. 3 at 26, and it will be seen that the malleable member, or wire, 25 extends into the member 20 of the base 12 and into the member 16 of the frame member 10. It will therefore be realized that one or a plurality of wires such as the wire 25 can be inserted into the base member 12, and extended across and beyond the hinge 26. With the wires in place, the user can simply hinge the base 12 with respect to the frame member 10, and the wire 25 will cause the base to remain in the set position.

Attention is next directed to FIG. 4 of the drawings which shows a frame very similar to the embodiment shown in FIGS. 1 thru 3. In FIG. 4, comparable parts carry the same numerals with a 1 prefix. Thus, it will be seen that the embodiment shown FIG. 4 of the drawings includes a base 112 and a frame member 110 with a backing 111. The frame shown in FIG. 4 is constructed of the same double sheet material, so wires 125 are placed in the material to cause the base 112 to remain at the set angle with respect to the frame member 110.

In the embodiment shown in FIG. 4, the front frame member 118 has the opening 115 which is the viewing area. The rear frame member 116 has a slightly larger opening designated at 115A. The protective sheet 114 is then received within the opening 115A and is held just rearwardly of the opening 115.

The backing 111 is die cut from the rear frame member 116, preferably cut on three sides so that a hinge remains. Obviously, the entire backing 111 could be cut from the rear frame member 116, but replacement would be somewhat more difficult, and the hinge arrangement renders the frame easier to use. Additionally, a finger hole 130 is provided to allow the backing 111 to be removed from the opening 115A.

It will therefore be seen that the embodiment of the invention disclosed in FIG. 4 is simple to construct since there is one piece of material that forms the rear frame member 116 and the backing 111, plus the base 112. One additional piece is cut for the front frame member 118, and the two pieces can be glued or heat sealed together. Wires 125 are inserted through the base 112 past the hinge 126, and the frame is substantially ready for use. The finger hole 130 provides a place to grip the backing 111 and pull it rearwardly. The close fit of the material yields sufficient holding power that the backing 111 will stay in place without additional clamps or the like.

Looking now at FIGS. 5 and 6 of the drawings, this embodiment of the invention includes the frame member 35 which comprises a rectangular piece of the plastic material discussed above with an opening 36 cut to expose a picture. There is a backing 38 which has the same outside dimension as the frame 35; and, it will be understood that a picture will be sandwiched between the frame member 35 and the backing 38.

The backing 38 h as a hole 39 cut therefrom, and the plug 40 that is removed from the hole 39 has a notch 41 cut therein. The plug 40 is thus receivable within the hole 39, and the close fit will hold the plug 40 within hole 39 well enough that the plug 40 will not be inadvertently removed. A stand member 42 is receivable within the plug 40 to support the frame on a flat surface.

More specifically, it will be seen that the ribs, or spacers in the plug 40 run generally vertically as the plug 40 is shown FIG. 5, and the notch 41 is at one end of the resulting channels. The short end 44 of the stand member 42 is therefore receivable within the channels of the plug 40, and the longer angled portion 45 protrudes through the notch 41 and outwardly to support the frame. The arrangement is shown in FIG. 6 with the frame standing. It will be seen that the plug 40 can be rotated 90 degrees so the frame can be turned horizontally, and the same stand member 42 will support the frame.

To hold the above described frame together, there is a cover desigated at 46. The cover 46 includes a transparent protective panel 48, and rearwardly turned edges 49. It will be seen that the edges 49 are turned rearwardly to form an acute angle with the protective panel 48. Thus, the frame member 35 and backing sheet 38 can be placed together, and can than be slid into the space defined by the flanges 49. While there is no mechanical device to prevent further sliding of the members 35 and 38, when the frame is sitting on a flat surface as indicated in FIG. 6, the material will not slide and the frame is reasonably secure.

Figure 7:
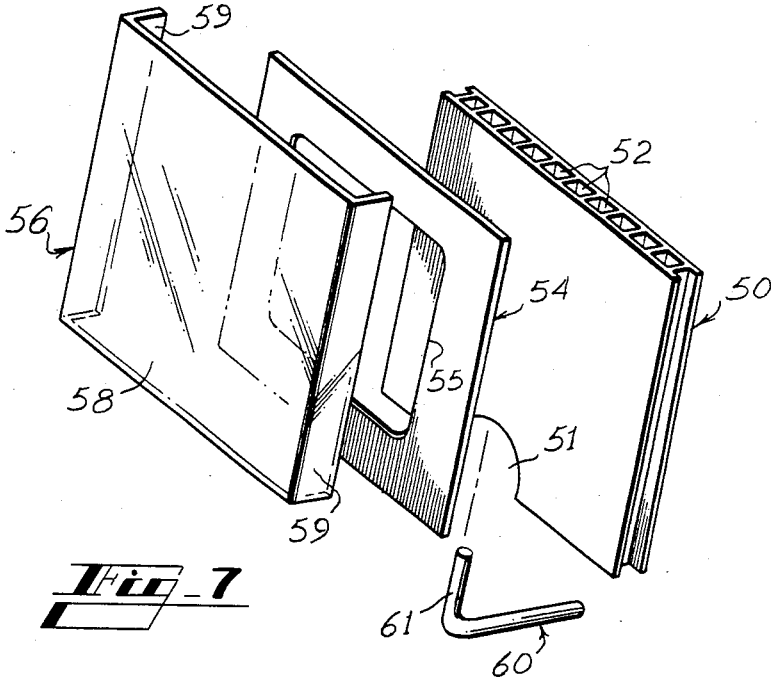
FIG. 7 is an exploded perspective view showing another modified form of the present invention; and, FIG. 8 is a view similar to FIG. 3, but showing the stand for the picture frame illustrated in FIG. 7.
Figure 8:
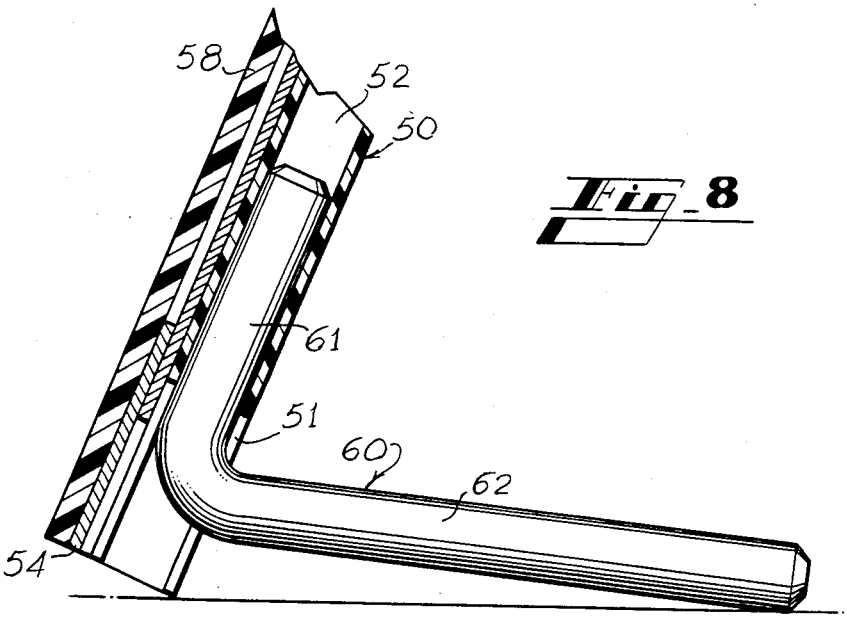

Attention is next directed to FIGS. 7 and 8 of the drawings for a further modification of the frame of the present invention. It will be seen that the embodiment of the invention disclosed in FIGS. 7 and 8 is similar to the embodiment illustrated in FIGS. 5 and 6.

In FIG. 7 it will be seen that there is a backing member 50, the backing member 50 being generally rectangular with a notch 51 cut in the lower edge thereof. It is important to note that the spacers in the material run vertically, to define a plurality of vertical channels 52. The notch 51 is therefore at the lower end of the channels 52.

The frame member designated at 54 in this embodiment of the invention is optional. The frame member 54 is formed of card stock or the like, though it will be course be obvious that the frame member 54 could also be formed of the double sheet plastic material previously discussed. The frame member 54 has the usual opening 55 therein.

As with the previously discribed embodiment, there is a clamping member designated at 56, the clamping member 56 including a transparent protective panel 58 and rearwardly turned flanges 59. The flanges 59 form an acute angle with the protective panel 58 so the frame member 54 and backing member 50 can be sandwiched together with a picture therebetween, and the clamping member 56 can be slide over the two to hold the other members together.

A stand member 60 is provided for supporting the picture frame on a flat surface. The stand member 60 includes a bent portion 61 that is receivable within one of the channels 52 in the backing member 50. As is best illustrated in FIG. 8, the bent portion 61 is preferably inserted into a channel in the vicinity of the notch 51. Thus, the longer portion 62 of the stand member 60 can extend rearwardly for engagement with the horizontal surface. The frame member tilts rearwardly so the frame is reasonably stable after assembly.

It will therefore be seen that the present invention provides a picture frame that can be very easily formed by die stamping material, the material being a thermoplastic that can be easily heat sealed together, or fixed together by appropriate adhesives or the like. By partially severing the material, a natural hinge is formed, so much of the frame can be provided by bending or folding the material and fixing contiguous panels together. When a hinge needs to retain its set position, malleable members are received within the channels in the material, and the malleable material holds the hinge in the chosen position.

It will of course be understood by those skilled in the art that the particular embodiments of the invention here presented are by way of illustration only, and are meant to be in no way restrictive; therefore, numerous changes and modifications may be made, and the full use equivalents resorted to, without departing from the spirit or scope of the invention as outlines in the appended claims.

I claim:

1. A picture frame for mounting a picture or the like, said picture frame including a frame member and a backing member, the picture being received against said backing member, said frame member and said backing member being formed of a double sheet material defining a plurality of channels therein between parallel sheets, and means received within at least one of said channels for causing said picture frame to stand on a horizontal surface for displaying a picture in said frame, and a transparent protective panel over said picture, said backing member defining a notch therein, said means received within at least one of said channels for causing said picture frame to stand on a horizontal surface comprising a rigid stand member including a bent portion and a stand portion, said bent portion being received within one of said channels in said backing member so that said stand portion extends outwardly at said notch, said stand portion having a length such that said stand portion will engage the horizontal surface for supporting said picture frame.

2. A picture frame as claimed in claim 1, said backing member including a plug formed of said double sheet material, and said backing member defining a hole from which said plug was cut, said plug being receivable within said hole in frictionally held relation, said notch being defined in said plug so that said bent portion of said stand member is received in said plug, the arrangement being such that said plug receives said rigid stand member and said backing member receives said plug in the desired orientation so that said rigid stand member supports said picture frame.

3. A picture frame as claimed in claim 2, and including a clamping member, said clamping member including said protective panel receivable against said frame member, said protective panel being transparent to allow the viewing of a picture therethrough, said clamping member including a pair of flanges extending rearwardly therefrom and forming an acute angle with said protective panel, said pair of flanges having such length as to receive said frame member and said backing member therebetween, said acute angle being such as to allow sliding motion of said members while said members remain between said flanges.

* * * * *